US006338814B1

(12) United States Patent
Hills

(10) Patent No.: US 6,338,814 B1
(45) Date of Patent: Jan. 15, 2002

(54) SPUNBOND WEB FORMATION

(75) Inventor: William H. Hills, Melbourne Village, FL (US)

(73) Assignee: Hills, Inc., West Melbourne, FL (US)

( * ) Notice: Subject to any disclaimer, the term of this patent is extended or adjusted under 35 U.S.C. 154(b) by 0 days.

(21) Appl. No.: 09/496,470

(22) Filed: Feb. 2, 2000

Related U.S. Application Data

(60) Provisional application No. 60/118,312, filed on Feb. 2, 1999.

(51) Int. Cl.[7] ..... D01D 5/098; D04H 3/02

(52) U.S. Cl. ..... 264/510; 156/148; 156/167; 156/176; 156/181; 156/244.24; 156/244.27; 156/436; 156/437; 156/441; 156/500; 264/103; 264/210.8; 264/211.12; 264/211.14; 264/555; 425/72.2; 425/363; 425/382.2; 425/383; 425/464

(58) Field of Search ..... 264/103, 210.8, 264/211.12, 211.14, 510, 555; 425/72.2, 363, 382.2, 383, 464; 156/148, 167, 176, 181, 244.24, 244.27, 436, 437, 441, 500

(56) References Cited

U.S. PATENT DOCUMENTS 3,802,817 A 4/1974 Matsuki et al.
5,298,097 A * 3/1994 Zanferrari ..... 156/181 X
5,538,682 A * 7/1996 Bornmann et al. ..... 264/555
5,545,371 A 8/1996 Lu
5,665,300 A * 9/1997 Brignola et al. ..... 264/555

* cited by examiner

*Primary Examiner*—Leo B. Tentoni

(57) ABSTRACT

A spunbond web formation apparatus includes a spinneret (1) of a spin pack (2) that extrudes an array of fibers (5) that are drawn into an aspirator (6). The attenuated fibers (8) discharged from aspirator (6) are deflected sideways by a Coanda device (7) that entrains the exiting air stream along with the fibers. The fibers are deposited on a vertically moving belt (9) and subsequently bonded by calender rolls (20, 21) to form a non-woven spunbond web. The spinning distance L is adjusted by vertically moving the aspirator (6), while the laydown distance M is adjusted by horizontally moving the belt (9) or aspirator (6) or by adjusting the size of the Coanda device (7). Deflection of the fibers exiting the aspirator permits the spinning distance L to be adjusted independently of the laydown distance M, without having to move the spin beam or adjust the height of the web-forming belt.

61 Claims, 4 Drawing Sheets

2/4

SPUNBOND WEB FORMATION

CROSS REFERENCE TO RELATED APPLICATION

This application claims priority from U.S. Provisional Patent Application Serial No. 60/118,312, entitled "Spunbond Web Formation," filed Feb. 2, 1999. The disclosure of this provisional patent application is incorporated herein by reference in its entirety.

BACKGROUND OF THE INVENTION

1. Field of the Invention

The present invention relates to methods and apparatus for forming spunbond webs and, more particularly, to formation of spunbond webs by deflection of extruded fibers onto a non-horizontal web-forming surface, such as a moving screen belt.

2. Description of the Related Art

Non-woven fabrics made from melt-spinnable polymers are commonly produced using spunbond processes. The term "spunbond" refers to a process of forming a non-woven fabric or web from an array of thin, melt-spun polymeric fibers or filaments produced by extruding molten polymer from orifices (the orifices can be, for example, those of a long, generally rectangular spinneret or of a plurality of spinnerets). Below the spinneret, the extruded fibers form a vertically oriented curtain of downwardly moving strands that are at least partially quenched before entering a long, slot-shaped air aspirator positioned below the spinneret. The aspirator introduces a rapid downwardly moving air stream produced by compressed air from one or more air aspirating jets. The air stream creates a drawing force on the fibers, causing them to be drawn between the spinneret and the air jet, thereby attenuating the fibers. Upon exiting at the bottom of the aspirator, the drawn fibers are randomly laid on a forming surface, such as a moving conveyor screen belt (e.g., a Fourdrinier wire), to form a continuous non-woven web of fibers. The web is subsequently bonded using one of several known techniques to form a stable, non-woven fabric. A common bonding method involves lifting the web from the moving screen belt and passing the web through two heated calender rolls. Often, one of the rolls is embossed, causing the web to be bonded in numerous spots. Carded or air-laid webs can also be formed from such polymeric fibers.

It has long been understood that the distances between the spinneret, aspirator and web forming surface are important parameters in the formation of non-woven webs, and the ability to adjust these distances is highly desirable, if not essential, in any apparatus designed to produce a variety of non-woven webs having different properties (e.g., denier, weight, texture, polymer composition, etc.). For example, in U.S. Pat. No. 3,802,817 to Matsuki et al., the disclosure of which is incorporated herein by reference in its entirety, it is recognized that good fiber formation and high production require optimization of the distance L from the spinneret to the aspirator (i.e., the "spinning" distance), and optimum web formation requires optimization of the distance M from the aspirator to the wire belt (i.e., the "laydown" distance). Unless the machine is dedicated to producing only one type of fabric, these distances must be varied in accordance with the desired fiber denier, the particular polymer being spun, and the fiber cross-sectional shape. In a large production spunbond machine, the spin beam containing the spin pack assembly (of which the spinneret is the bottom element) has a weight of several tons, since the spin beam is a pressure vessel using boiling Dowtherm or a similar liquid/vapor material to provide uniform heat. The beam also contains metering pumps to control the polymer rate through the spinneret. For an apparatus making a web of three meters or more in width, the forming table, which controls and drives the Fourdrinier wire, also weighs several tons. The aspirator is not quite as heavy and is typically more compact than the beam and forming table; nevertheless, the aspirator may weigh over one ton for a three-meter machine.

Conventionally, two of the three major machine elements must be moveable in the vertical direction to enable independent adjustment of the spinning distance L and the laydown distance M. Moving the spin beam is particularly problematic, since the spin beam is fed molten polymer through heated piping from a screw extruder that also weighs several tons. If the piping is fitted with rotary joints, it is possible to raise and lower the beam while the extruder is at a fixed height; however, these rotary joints are prone to leakage when operated at 280° C. and over 1000 psig polymer pressure, which are normal operating conditions. The extruder can be raised and lowered with the beam to allow shorter piping and no rotary joints, but then the additional several ton weight of the extruder must be lifted along with the beam.

If, instead, the spin beam remains at fixed height and the forming table and aspirator are adjusted vertically, considerable additional expense will be incurred in providing the capability to move these components, particularly the forming table. Also, if the forming table is moved vertically, independent adjustment of spinning distance L cannot be achieved on a machine with multiple beams and aspirators. Independent adjustment is desirable in any number of circumstances where plural beams and aspirators produce plural arrays of fibers. One example is in the production of a laminated fabric where, for example, there are three laydown zones and the middle zone produces fibers of much finer denier than the first and second zones, capturing a fine denier web between two coarser denier webs. Such independent adjustments cannot be achieved by raising or lowering a horizontal forming table and are very expensive if achieved by individually raising or lowering each spin beam with its related piping, pump drives and quench ducts.

Another problem encountered with spunbond processes occurs when the spinning distance L is kept particularly short in order to permit formation of fine fibers at high production speeds. U. S. Pat. No. 5,545,371 to Lu, the disclosure of which is incorporated herein by reference in its entirety, describes a process wherein the distance L is less than 50 cm, and this distance is adjusted to control the diametric size of the filaments (fiber denier). Adjusting the spinning distance L will also change laydown distance M, unless laydown distance M can be independently adjusted by raising or lowering the screen wire, as is shown in the Lu patent. When the spinning distance L is short (e.g., less than 50 cm), the process can be operated under certain conditions of polymer flow (normally expressed in grams/spinneret orifice/minute) and aspirator air velocity. However, if the polymer flow or air velocity is too high, the fibers will not cool sufficiently and will break between the spinneret and the aspirator. Each break is followed by a drip of polymer at the leading end of the new fiber that is forming from the spinneret orifice where the break occurred. If the process conditions are such that very few fiber breakages occur, economical web production can take place. On the other hand, if frequent fiber breakages occur, these drips can land on the Fourdrinier belt while still hot and become bonded to the belt as the belt passes through the compaction rolls. The belt must then be stopped and production lost in order to periodically clean the belt. Until the belt is cleaned, the drips stuck to the belt can snag fibers in the web and cause web damage.

Accordingly, there remains a need to improve upon conventional spunbond web formation techniques for adjusting the spinning and laydown distances and to mitigate the detrimental effects of polymer drips that occur during spunbond web formation.

SUMMARY OF THE INVENTION

Therefore, in light of the above, and for other reasons that become apparent when the invention is fully described, an object of the present invention is to provide a process and apparatus that significantly reduces the cost of spunbond machinery by eliminating the need to raise and lower the spin beam and the forming table while preserving the ability to independently adjust the spinning distance L and the laydown distance M.

Another object of the present invention is to separate a significant portion of polymer drips from the extruded fibers before the drips can land on the web-forming belt, thereby reducing belt damage and downtime resulting from polymer drips.

Yet another object of the present invention is to permit formation of a web in two or more stages from two or more spin beams and aspirators, thereby increasing the production rate of the machine.

Still another object of the present invention is to permit independent adjustment of the distance from the spinneret to the aspirator (i.e., the spinning distance) for each of multiple stages of laydown (e.g., for two separate arrays of polymers respectively extruded from two spin beams).

Another object of the invention is to provide a spunbond machine with improved operator accessibility and easier installation of spin packs.

The aforesaid objects are achieved individually and in combination, and it is not intended that the present invention be construed as requiring two or more of the objects to be combined unless expressly required by the claims attached hereto.

In accordance with the present invention, the aforementioned difficulties associated with independently adjusting the spinning distance L and the laydown distance M are overcome by employing novel techniques for adjusting the laydown distance M that do not involve raising or lowering the spin beam or forming table. More specifically, once an array of fibers extruded from the spinneret of a spin pack are drawn through an aspirator, the attenuated fibers discharged from the bottom of the aspirator are deflected at a significant angle with respect to vertical and deposited on a web-formation belt that is oriented non-horizontally. For example, the fibers can be deflected sideways a full 90°, causing the fibers to travel horizontally, and can subsequently be deposited on a vertically moving screen belt. Efficient deflection of the fibers can be achieved using a Coanda device that entrains the air flow exiting the aspirator along a smooth curved surface in accordance with the Coanda effect. In this arrangement, the laydown distance M between the trailing edge of the Coanda device and the web-forming belt does not lie along a vertical line, as in conventional devices. Rather, in the case of a 90° deflection angle and a vertically oriented web-forming belt, the laydown distance M is a horizontal distance that can be modified by horizontally moving the forming table supporting the belt, by horizontally moving the aspirator, and/or by altering the distance between the belt and the trailing edge of the Coanda device (e.g., by adjusting the size or shape of the Coanda device). The spinning distance L, which is not affected by adjustment of the laydown distance M, can be independently adjusted by raising or lowering the aspirator in a conventional manner. The apparatus of the present invention thereby advantageously avoids the need to move the spin beam and the need to raise or lower the forming table, while permitting independent adjustment of the spinning distance L and the laydown distance M.

Further, a substantial portion of the heavier polymer drips that develop during fiber extrusion will not be entrained and deflected by the Coanda device and will fall vertically downward from the aspirator output into a collection trough. Consequently, these drips will not reach the web-forming belt and cause the aforementioned problems associated with polymer drips fusing to the screen belt. Accordingly, the frequency with which the belt requires cleaning is reduced and production time and efficiency are increased.

In accordance with another embodiment of the present invention, the fiber deflection technique of the present invention is applied to form a double-layer web by separately depositing two fiber arrays at two different points along the path of the web-forming belt. The belt is routed by rolls such that two different vertical surfaces are formed by the belt along its path. The above-described fiber deflection technique is employed to deposit one array of fibers onto one of the vertical belt surfaces, while a second, similar spin beam/aspirator arrangement is used to deposit another array of fibers on top of the first array of fibers at a point on the second vertical surface. In this embodiment, both the spin beams and the forming table/belt are mounted in a fixed position. Nevertheless, the spinning distances L and laydown distance M for each of the fiber arrays can be adjusted independently by moving the associated aspirator and/or by changing the size or shape of the associated Coanda device.

In accordance with another embodiment of the present invention, the fibers discharged from the aspirator are deflected at an angle of less than 90° (but preferably at an angle of at least 45°) onto a belt traveling at an inclined angle, such that the fibers are directed substantially normal to the belt. The inclined belt can be a short belt that is separate from a main conveyor belt. Because the short inclined belt can be moved substantially independent of the main belt, this arrangement offers the advantage of greater ease and flexibility in adjusting the laydown distance M to the inclined belt. The inclined belt unit also provides greater room and flexibility for positioning quenching ducts in the vicinity of the spin beam. In a two or more layer web formation process, two or more separate short belts can respectively deliver webs to a main belt where the webs are overlaid and bonded.

While the use of a Coanda device to deflect the arrays of fibers is preferable, other mechanisms can be used to effectively deflect the fibers exiting the aspirator onto a non-horizontal belt. For example, a curved deflection plate can be placed at the output of the aspirator to direct the fibers in a sideways direction.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
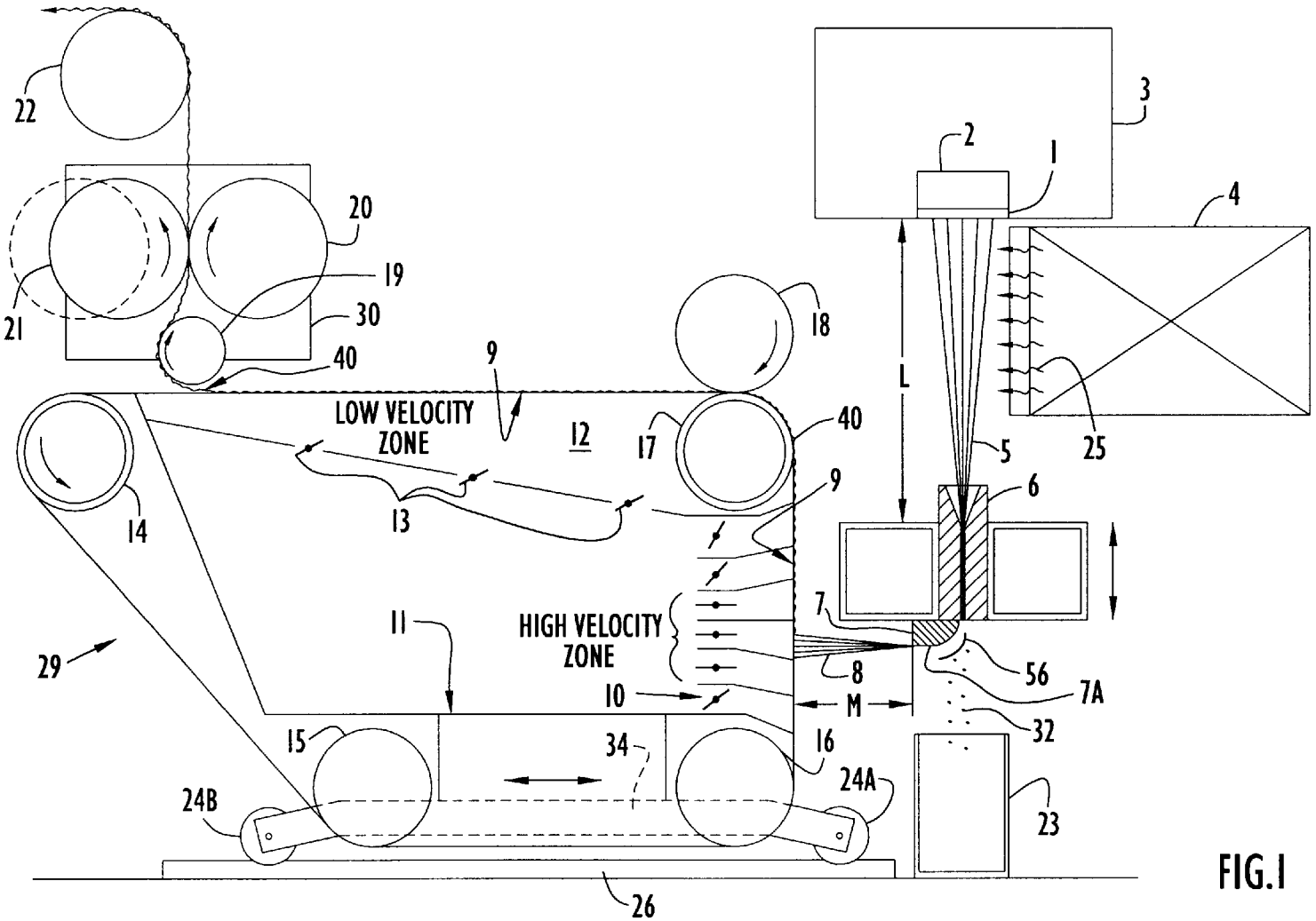
FIG. 1 is a diagrammatic side view in partial section of a spunbond web forming apparatus in accordance with a first embodiment of the present invention.

The following detailed explanations of FIGS. 1–4 and of the preferred embodiments reveal the method and apparatus of the present invention. FIG. 1 illustrates a spunbond web formation apparatus according to a first embodiment of the present invention. Referring to FIG. 1, molten polymer is supplied from an extruder (not shown) to a spin pack 2 contained in a heated spin beam 3, which is located at a fixed height (i.e., spin beam 3 does not move in the vertical direction for purposes of adjusting the spinning distance L between the spinneret and the aspirator). As used herein, the term "spin pack" refers to the assembly for processing the molten polymer to produce extruded polymer streams, including final polymer filtration, distribution systems and the spinneret. As used herein, the term "spinneret" refers to the portion of the spin pack that delivers the molten polymer to and through orifices for extrusion into the environment. The spinneret can be implemented with holes drilled or etched through a plate or any other structure capable of issuing the required fiber streams.

Referring again to FIG. 1, the lower most element of spin pack 2 is spinneret 1, which contains an array of spinning orifices, typically from 1000 to 5000 per meter of length of the spinneret. An array of fibers 5 is formed from the polymer streams extruded from the orifices of spinneret 1 of spin pack 2 and is pulled downward and attenuated by an aspirator 6 that is fed by compressed air or steam from a pipe (not shown). Aspirator 6 can be, for example, of the gun type or of the slot type, extending across the full width of the fiber array, i.e., in the direction corresponding to the width of the web to be formed by the fibers. A typical spinneret and aspirator arrangement useful for this process is illustrated in aforementioned Matsuki patent.

In conventional processes, such as those described in the aforementioned patents, the fibers continue vertically through the aspirator and are deposited on a substantially horizontal moving screen belt. In accordance with the present invention, the air stream and fibers exiting aspirator 6 are deflected sideways by a curved Coanda device 7 that subjects the air stream and fibers to the Coanda effect. The Coanda effect is a fluidic phenomenon, wherein a substantially laminar flow of fluid (e.g., air or liquid), passing in the vicinity of a surface, tends to follow the curvature of the surface (i.e., the flow is "entrained" by the surface), provided that the curvature is sufficiently gradual for a given flow rate.

In accordance with a preferred embodiment of the present invention, the Coanda effect is used to deflect the vertically traveling fibers exiting the aspirator. As shown in FIG. 1, attenuated fibers 8 are discharged from a generally slot-shaped output of aspirator 6. Coanda device 7 includes a Coanda surface 7*a* that resembles one fourth of a substantially cylindrical surface (i.e., one quarter of the circumference of an ellipse or circle). The leading edge of the Coanda surface 7*a* extends along the width of the slot-shaped aspirator output (in the view shown in FIG. 1, the width dimension is into the page), such that Coanda surface 7*a* is substantially flush with one edge of the aspirator output. At the leading edge, a tangent to Coanda surface 7*a* is substantially vertical. From the leading edge, Coanda surface 7*a* extends through a substantially 90° arc, terminating at a trailing edge. At the trailing edge, a tangent to Coanda surface 7*a* is substantially horizontal. By way of non-limiting example, Coanda surface 7*a* can be a curved piece of sheet metal or other sheet-like material that is bolted or fastened to a bottom and/or side surface of aspirator 6. In the embodiment shown in FIG. 1, the Coanda surface follows a substantially elliptical shape with the major axis of the ellipse lying horizontally, wherein the radius of curvature of the Coanda surface increases from a minimum at the leading edge to a maximum at the trailing edge.

A stream of downwardly directed air exiting the output of aspirator 6 flows directly past the leading edge of the Coanda surface. The Coanda surface immediately entrains the downward air stream, deflecting the air stream through approximately 90° as the air stream follows the contour of the Coanda surface, resulting in a substantially horizontal air stream at the trailing edge of the Coanda surface. For typical air flow rates, the radius of curvature of the Coanda surface can be on the order of several inches. For example, successful operation has been demonstrated using a Coanda device whose radius of curvature is approximately four inches, and a radius of curvature between approximately four inches and twenty inches would be suitable for typical air flow rates. It should be understood that these dimensions and all other dimensions provided herein are by way of example only and are not to be construed as limiting in any way the scope of the invention.

Since the fibers 8 exiting aspirator 6 are very fine and have a high surface to weight ratio, fibers 8 are easily entrained in the deflected air stream. Once fibers 8 flow past the trailing edge of Coanda surface 7*a,* the fibers continue to travel substantially horizontally until they are deposited on a web-forming vertical moving belt 9. The distance traversed by fibers 8 between the trailing edge of Coanda surface 7*a* and belt 9 is the laydown distance M.

Polymer drips 32 are larger and heavier than fibers 8; consequently, many of the drips 32 are separated from the fibers 8 by centrifugal force as the fibers pass around Coanda device 7. The drips 32 fall into a collection trough 23 that extends along the width of the apparatus. While some drips may adhere to adjacent fibers or become entangled in adjacent fibers and be carried around Coanda device 7 and onto belt 9, the number of drips reaching web-forming belt 9 is nevertheless substantially reduced. Web-forming belt 9 can be, for example a screen belt through which air can pass, such as a Fourdrinier wire belt.

A suction box 11 disposed behind the vertical belt 9 pulls the aspirator air and a substantial volume of room air (at the ambient temperature) through the belt, holding the fibers onto the belt in the form of a non-woven web 40. High velocity dampers 10 behind the vertical belt are adjusted to provide the greatest suction box airflow in the region where the fibers impact the belt as well as just below and above this region (indicated as "high velocity zones" in FIG. 1). Air entering the suction box 11 through belt 9 exits at the near and far ends of the suction box 11 and passes to a large fan (not shown).

Belt 9 carrying web 40 next turns 90° and passes through a pair of compaction rolls 17 and 18 to compress the web and give the web greater strength for later passage to calender rolls. Even after compaction, web 40 is still not bonded and is quite delicate. After the compaction rolls, additional suction box air can be pulled through the belt as it travels horizontally, keeping the web from being blown loose from the belt. Dampers 13 control the low air velocity in this low air velocity zone 12 beneath the horizontal portion of belt 9.

Additional rolls 14, 15 and 16 support web-forming screen belt 9. In particular, roll 14 is rubber covered and is driven to control the speed of the belt, in turn controlling the weight per unit area of the web. Guide roll 15 can be adjusted slightly out of parallel with rolls 14, 16 and 17 in a conventional manner to track or guide the belt so as to keep belt 9 from running off the ends of the rolls. The remaining rolls can be idler rolls.

Rolls 14 through 18 are supported by a frame 34 that has wheels 24*a* and 24*b* running on a track 26, allowing rolls 14–18, frame 34, suction box 11 and screen belt 9 to be rolled horizontally. Rolls 14–18, belt 9, suction box 11, frame 34 and wheels 24*a* and 24*a* are collectively referred to as the forming table 27. The movement of forming table 27 along track 26 permits adjustment of the laydown distance M from Coanda device 7 to vertical belt 9. Typically, the laydown distance M is adjusted to yield the most uniform web. Draw unit 6 is adjustable vertically (by two jack screws or other conventional means not shown) in order to adjust fiber spinning distance L to a distance that gives the desired fiber denier at a given polymer flow rate and aspirator air velocity. As draw unit 6 is adjusted upward or downward, high velocity dampers 10, which locally control the velocity of the air drawn through screen belt 9 by suction box 1, are readjusted to give the highest air velocity where the fibers initially contact belt 9. As will be understood from the foregoing, the apparatus of the first embodiment of the present invention permits independent adjustment of the spinning distance L and laydown distance M without vertically adjusting the height of the spin beam 3 or the forming table. The height only of the aspirator requires adjustment.

A quench air duct supplying cool air 25 across the extruded fibers 5 below the spinneret (and above aspirator 6) is shown in FIG. 1. The use of such quench air is conventional since it permits quicker fiber cooling and hence greater permissible polymer flow rates and more rapid web production. In certain circumstances, it is desirable to direct quench air onto the fiber curtain from both sides. In this case, the pair of compaction rolls 17 and 18 can be located further downstream on the belt (moved to the left in FIG. 1), closer to the calender rolls, and an idler roll can replace roll 17. Accordingly, roll 18 is moved out of the way to allow installation of a quench air duct directing air from the side opposite quench air duct 25 (i.e., located on the left of fibers 5 and directing air from left to right in the arrangement shown in FIG. 1).

Referring once again to FIG. 1, the non-woven web 40 is lifted from the horizontally oriented portion of belt 9 by driver roll 19, and the web passes vertically through a nip formed between heated calender rolls 20 and 21 for bonding. For example, one of the calender rolls can be embossed to have raised nodules which fuse the fibers together only at the points where the nodules contact the web, leaving the fibers between the bond points still bulky and giving the resultant bonded non-woven fabric good flexibility and drape. Other conventional bonding techniques can be employed to bond the web, including, but not limited to: through-air bonding; needle punching; and hydroentangling (i.e., use of high-pressure water jets).

As shown in FIG. 1, web 40 next proceeds around driven cooling roll (water-cooled) 22 and passes to a fabric winder (not shown). Having the two calender rolls in a horizontal plane provides the advantage of easy lifting of a damaged roll 20 or 21 by crane from the top of calender frame 30. Calender roll 20 is mounted in a translationally fixed position, while calender roll 21 is horizontally moveable into and out of engagement calender roll 20 (as indicated with dashed lines in FIG. 1). In operation, calender roll 21 is urged into engagement with calender roll 20 by hydraulic or pneumatic means to form a nip. Rolls 19, 20, 21 and 22 are all supported in a stationary frame 30 and do not travel back and forth with the forming table. Since these rolls are fixed in space, web 40 is lifted from belt 9 just below driver roll 19, regardless of the laydown distance M between the trailing edge of Coanda surface 7*a* and the vertical belt 9. This apparatus design eliminates the need to jack up and down the many-ton weight of the forming table, reducing capital cost significantly. In practice, it may be possible to eliminate driver roll 19, since calender rolls 20 and 21 can be configured to lift web 40 off of belt 9.

Thus, sideways deflection of the attenuated fibers discharged from the aspirator permits adjustment of the laydown distance M merely by rolling the forming table back and forth along track 26. In addition, this arrangement permits separating a substantial portion of the drips from the fibers by centrifugal force, eliminating some lost production time and expense to remove drips from the belt.

The laydown distance M can also be adjusted by altering the size of the Coanda device. Due to the entrainment of the airflow and fibers along the Coanda surface, the distance along the Coanda surface effectively is not part of the laydown distance M; rather, the laydown distance M begins at the trailing edge of the Coanda surface. Consequently, the laydown distance M can be increased or decrease by moving the location of the trailing edge of the Coanda surface relative to the output of the aspirator. This movement can be achieved by increasing or decreasing the radius of curvature of the Coanda surface (as the radius of curvature increases, an arc of a given angle extends further in the horizontal direction and closer to the vertical belt). Thus, for example, a 90° Coanda surface having a four inch radius results in a longer laydown distance than a 90° Coanda surface having a six inch radius of curvature. More generally, the laydown distance can be decreased simply by extending the Coanda surface in the direction of the belt along a straight or curved contour. In practice, the length of the Coanda surface can be adjusted by attaching different removable Coanda devices to the aspirator in accordance with a desired laydown distance M (i.e., different Coanda devices of various sizes and configurations can be attached).

Where the Coanda surface is formed of sheet metal, the laydown distance M can also be adjusted by varying the shape of the Coanda device. Specifically, the leading edge of the Coanda surface is attached in a fixed position to the aspirator adjacent the output. The trailing edge of the Coanda surface is connected to a moveable bar (not shown) lying on the inside of the Coanda surface. Because the sheet metal is relatively malleable, the shape of the Coanda surface and the location of the trailing edge can be adjusted by repositioning the bar. For example, by moving the bar horizontally toward the web-forming screen belt, the laydown distance can be decreased without exchanging or replacing the Coanda device. As the bar is moved toward the web-forming belt, the Coanda surface becomes more elliptical in cross-section; conversely, the Coanda surface becomes more round in cross-section as the bar is moved away from the belt.

Figure 2:
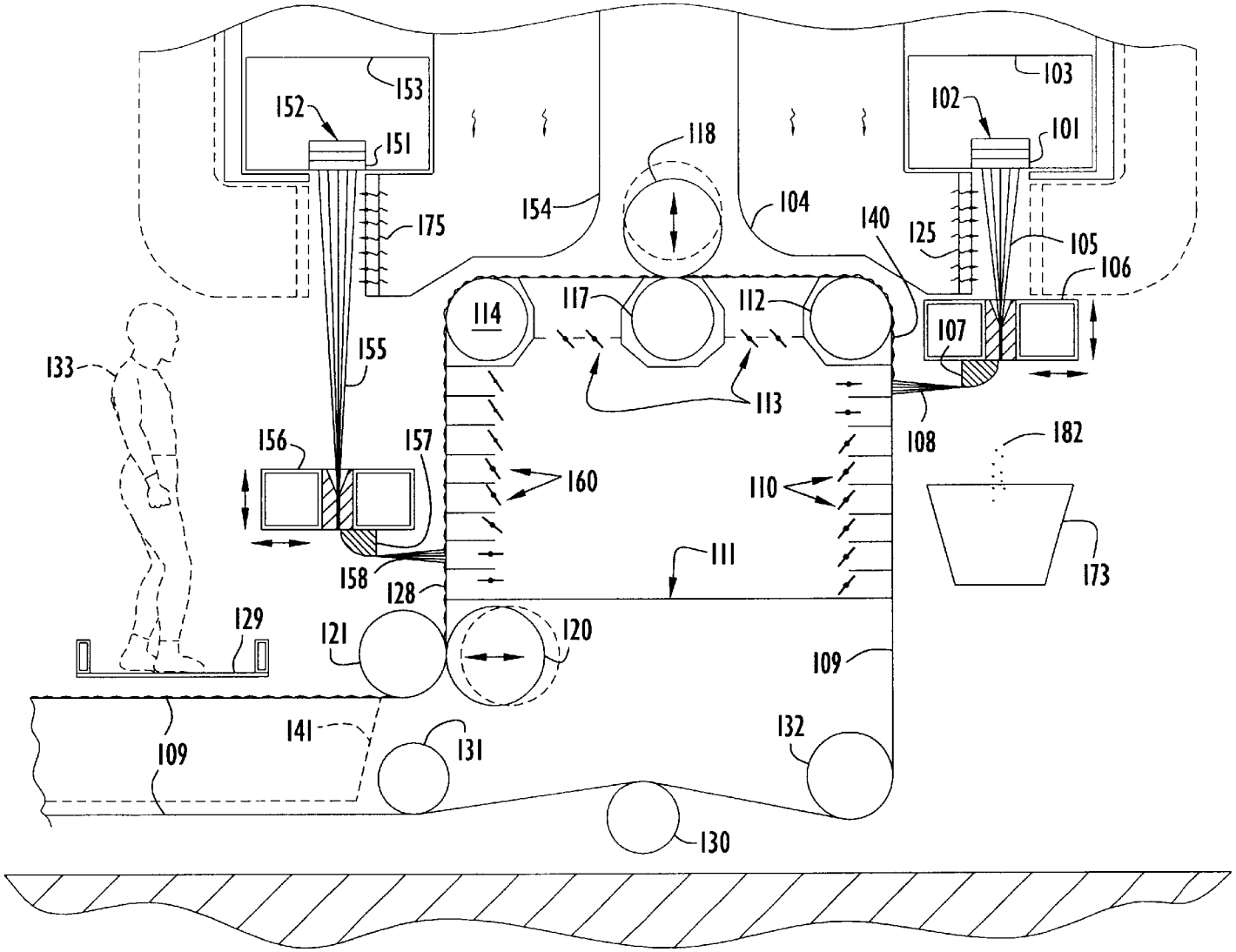
FIG. 2 is a diagrammatic side view in partial section of a spunbond web forming apparatus in accordance with a second embodiment of the present invention.

A second embodiment of the present invention involving a two-stage web laydown is illustrated in FIG. 2. In accordance with the second embodiment, a spunbond web formation apparatus includes two spin beams 103 and 153, including respective spin packs 102 and 152 and spinnerets 101 and 151 extruding fiber arrays 105 and 155, as well as two aspirators 106 and 156 that deposit respective arrays of fibers 108 and 158 onto separate vertical surfaces of a common belt 109. More specifically, in the first stage of the web laydown, a Coanda device 107 disposed at the output of aspirator 106 horizontally deflects the attenuated fibers 108 discharged from aspirator 106 onto a portion of belt 109 that is moving vertically upward, thereby forming a non-woven web 140 on belt 109. As belt 109 travels up and around roll 112, the belt rotates 90° such that web 140 is conveyed horizontally. Web 140 then passes through compaction rolls 117 and 118 before traveling vertically downward as belt 109 turns 90° while passing over roll 114 (as shown with dashed lines in FIG. 2, compaction roll 118 can be moved vertically into and out of engagement with compaction roll 117).

The second stage of the web laydown involves depositing a second web on top of the first web 140 already on belt 109. Specifically, another Coanda device 157, disposed at the output of aspirator 156, horizontally deflects the attenuated fibers 158 discharged from aspirator 156 toward the downward traveling portion of belt 109, such that fibers 158 are deposited on top of web 140, thereby forming a double-layer web 128.

A common suction box 111 draws air through both the upward-traveling and downward-traveling vertical surfaces of belt 109 as well as the upper horizontally-traveling surface of belt 109. Dampers 110 adjacent the upwardly-traveling vertical surface of belt 109 are adjusted to create a high velocity air flow zone in the vicinity of the laydown area of fibers 108, while dampers 160 adjacent the downwardly-traveling vertical surface of belt 109 are adjusted to create a high velocity air flow zone in the vicinity of the laydown area of fibers 158. Dampers 113 are adjusted to create a low velocity air flow zone beneath the upper horizontally-traveling surface of belt 109.

The double-layer web 128 continues to travel vertically downward until it passes through compaction rolls 120 and 121 (as shown with dashed lines in FIG. 2, compaction roll 120 can be moved vertically into and out of engagement with compaction roll 121). Belt 109 turns 90° as it passes around compaction roll 121, and conveys double-layer web 128 horizontally toward calender rolls (not shown) where the two layers are bonded together. An optional low suction hold-down duct 141 can be positioned below the horizontal portion of the belt 109 carrying the double-layer web 128 to prevent the web from being displaced from the belt 109. Additional rolls 130, 131 and 132 support web-forming screen belt 109. In particular, roll 130 can be a guide roll that is adjustable slightly out of parallel with rolls 112, 114, 131 and 132 to track or guide the belt 109 so as to keep belt 109 from running off the ends of the rolls. One of the rolls 112, 114, 131 and 132 can be the drive roll, while the remaining rolls can be idler rolls.

As with the first embodiment, a substantial number of polymer drips 182 are separated from the stream of fibers at the output of the aspirator and fall into a drip collection trough 283. For convenience and to maintain the simplicity of the drawing, the drip collection trough is not shown beneath aspirator 156 in FIG. 2; however, it will be understood that a drip collection trough is located below each of the aspirators.

As shown in FIG. 2, quench air ducting 125 and 175 corresponding to spin beams 103 and 153 are located above the suction box region, making it possible for an operator to see the curtain of fibers traveling from the spinneret to the aspirator. Using a large mirror (not shown), an operator standing at the end of the apparatus can view both areas of web deposition. Standing on a catwalk 129 adjacent the deposition area of the second (overlaying) web, an operator 133 can look at the double-layer web 128 as it emerges from under catwalk 129 and inspect the double-layer web 128 for any defects.

In the configuration shown in FIG. 2, the laydown distance M is adjustable by moving the aspirator (106 or 156) horizontally, and the spinning distance L is adjustable by moving the aspirator vertically. Moving the aspirator horizontally will cause the fiber curtain (105 or 155) to travel at a small angle from the vertical when leaving the spinneret (101 or 151). However, an angle of up to 15° off of vertical causes little problem in good fiber formation or spinning. Consequently, a significant variation of the laydown distance M can be achieved by moving the aspirator horizontally, particularly, when the spinning distance (i.e., the distance from the aspirator to the spinneret) is relatively long.

When spinning distance L is very short (e.g., at the highest aspirator position), the horizontal distance that the aspirator can be moved before exceeding an angle of 15° for the fibers leaving the spinneret is relatively short (as compared to the allowable horizontal movement at longer spinning distances). Thus, at very short spinning distances L, the range over which the laydown distance M can be adjusted by moving the aspirator horizontally may be too restrictive. This problem can be solved by varying the radius or horizontal length of the Coanda device (107 or 157) to adjust the laydown distance M in the manner described above, such that the point at which the fibers leave the Coanda device is closer to or further from the belt. The techniques of varying the laydown distance M by moving the aspirator horizontally and changing the size of the Coanda device can be used individually or in combination. Note that the calender rolls (not shown) used in conjunction with the apparatus of the second embodiment can have rolls disposed horizontally (as shown in FIG. 1) or rolls stacked vertically in the conventional manner, since the forming table is not being rolled back and forth to adjust laydown distance M.

As will be understood from the foregoing, the web formation apparatus of the second embodiment permits the spinning distance L and laydown distance M to be independently varied for each of the two laydown processes simply by moving the aspirator (and not the spin beam or forming table) and, optionally, by adjusting the size of the Coanda device. Moreover, adjustments can be made to the spinning distance L and laydown distance M of one of the laydown processes independent of the other laydown process (i.e., each spinning distance L and laydown distance M is separately and independently adjustable).

By employing a two-stage fiber laydown technique, the speed of the web-forming belt can be doubled while still producing a web having the same weight/thickness as single-layer web formed at non-doubled belt speed, thereby doubling production of the apparatus. This doubling of production reduces the overall cost of the equipment per meters of web formed. Specifically, while two spin beams and aspirators are required, downstream of the aspirator the components of only a single production line are required to yield the output of two production lines. That is, only one forming table, one set of calender rolls, one each of various web treatment apparatus (e.g., for applying resins or for web drying), one web winder, etc. is required rather than the two of each of these components that would be required with two separate production lines producing the same total output. These downstream components contribute significantly to the overall cost of the apparatus.

Figure 3:
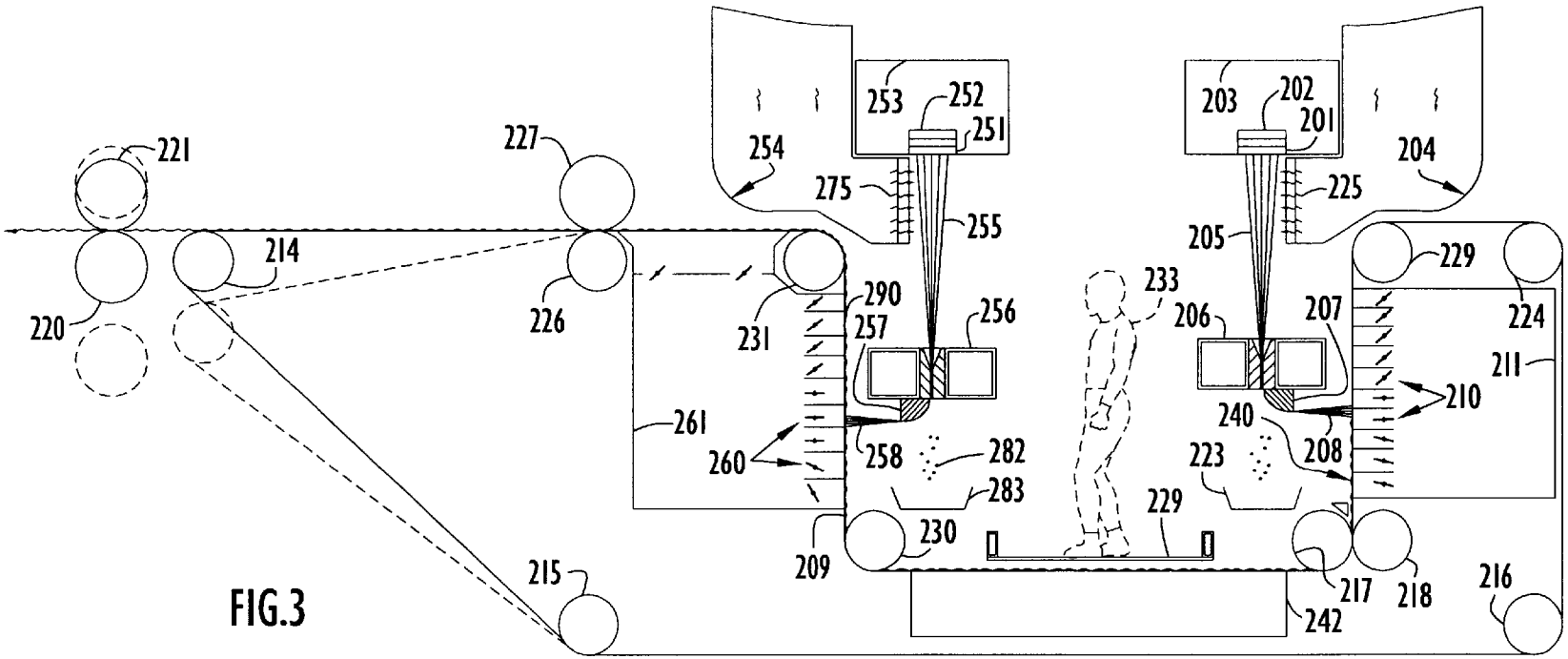
FIG. 3 is a diagrammatic side view in partial section of a spunbond web forming apparatus in accordance with a third embodiment of the present invention.

A third embodiment of the present invention involving another two-stage web laydown arrangement is illustrated in FIG. 3. The apparatus of the third embodiment is similar in operational principle to that of the second embodiment in that fibers are deposited on two separate vertical surfaces to form a two-layer web. However, in the arrangement shown in FIG. 3, the web-forming screen belt is traveling vertically downward at the first point of deposition and is traveling vertically upward at the second point of deposition (the opposite of the second embodiment). More specifically, in the first stage of the web laydown, an array of fibers 205 is extruded from the spinneret 201 of spin pack 202 of spin beam 203 and drawn into an aspirator 206. A Coanda device 207 disposed at the output of aspirator 206 horizontally deflects the attenuated fibers 208 discharged from aspirator 206 onto a portion of web-forming screen belt 209 that is moving vertically downward, thereby forming a non-woven web 240 on belt 209.

The portion of belt 209 conveying web 240 next turns 90° and passes through a pair of compaction rolls 217 and 218 and rotates 90° around compaction roll 217 to convey web 240 horizontally. An optional mild suction box 242 can be position beneath the horizontally oriented portion of the belt to prevent web 240 from being blown off of belt 209. As shown with dashed lines in FIG. 3, compaction roll 218 can be moved horizontally into and out of engagement with compaction roll 217. Belt 209 then rotates 90° around roll 230 and proceeds with web 240 vertically upward toward the second fiber deposition location.

A second array of fibers 255 is extruded from a spinneret 251 of a spin pack 252 of a second spin beam 253 and drawn into an aspirator 256. A Coanda device 257 disposed at the output of aspirator 256 horizontally deflects the attenuated fibers 258 discharged from aspirator 256 toward the upward traveling portion of belt 209, such that fibers 258 are deposited on top of web 240, thereby forming a double-layer web 290. Drip collection troughs 223 and 283 are respectively located below aspirators 206 and 256 to collect polymer drips 282.

Double-layer web 290 is conveyed by belt 209 up and around roll 231, travels horizontally through compaction rolls 226 and 227, and finally through calender rolls 220 and 221 for bonding. As shown in FIG. 3, the calender rolls are arranged vertically in the conventional manner. Optionally, a third calender roll can be positioned vertically in line with rolls 220 and 221. In this arrangement, the center calender roll is typically smooth, while the top and bottom rolls are patterned (e.g., with raised nodules) for forming bonding points. If one of the patterned rolls becomes damaged or requires maintenance, the web can be fed between the center roll and the other patterned roll. As shown in FIG. 3, a nose roll 214 is moved vertically upward or downward to align the belt and web with either the nip formed between the upper and center calender rolls or the nip formed between the center and lower calender rolls.

The arrangement of the third embodiment advantageously allows an operator 233 to easily view both fiber deposition areas from a single catwalk 229, or from a point to one side of the machine. Note that quench air ducts 204 and 254 respectively delivering quench air 225 and 275 to fiber arrays 205 and 255 are located on the outer sides (as opposed to in between) of spin beams 203 and 253 to provide easier access for the operator between the spin beams. However, the apparatus shown in FIG. 3 requires two suction boxes 211 and 261 with corresponding dampers 210 and 260 for the two respective laydown areas. Further, web-forming belt is required to be somewhat longer than that required in the arrangement of the second embodiment, and more rolls (214, 215, 216, 217, 218, 224, 226, 227, 229, 230, 231, 241) are required.

Figure 4:
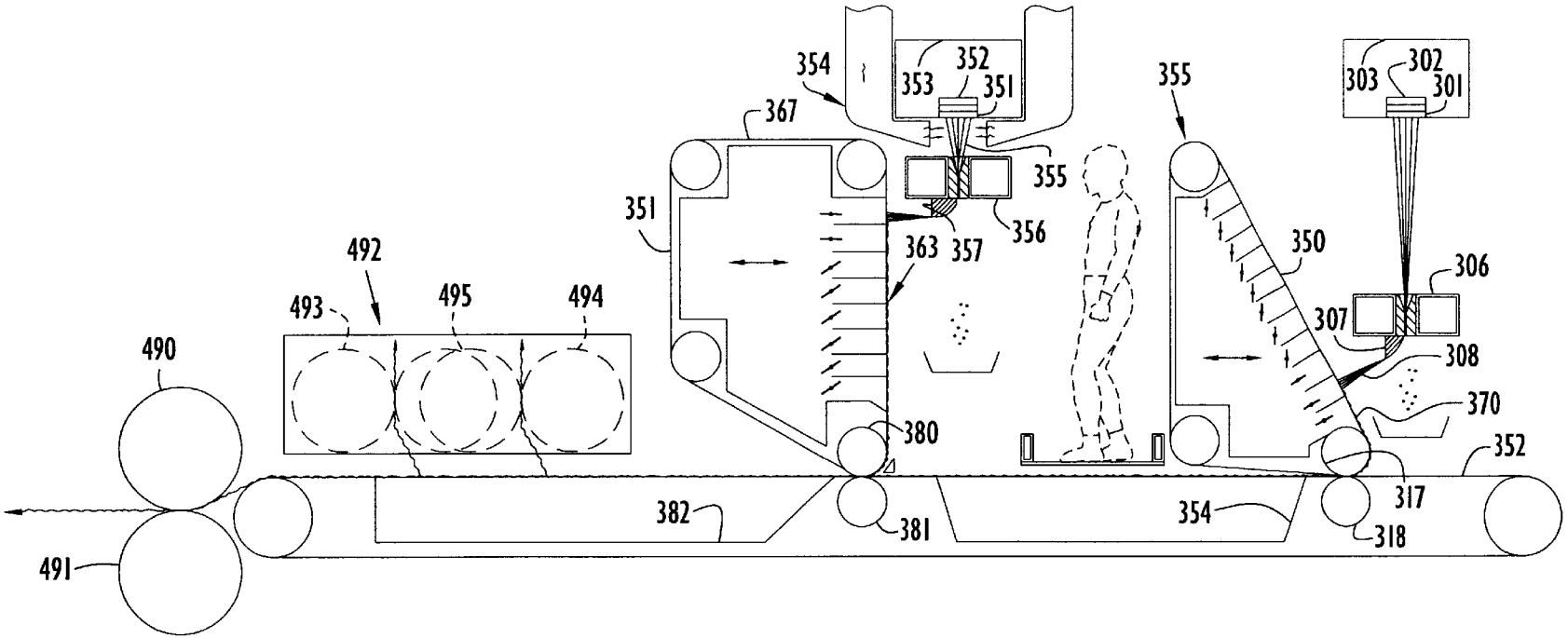
FIG. 4 is a diagrammatic side view in partial section of a spunbond web forming apparatus in accordance with a fourth embodiment of the present invention.

A fourth embodiment of the present invention is illustrated in FIG. 4. In the fourth embodiment the two fiber arrays are initially deposited onto respective short, supplemental belts that deliver the fiber webs to a main belt where the webs are overlaid and subsequently bonded. As shown in FIG. 4, in one stage of the web laydown, an array of fibers 305 is extruded from the spinneret 301 of spin pack 302 of spin beam 303 and drawn into an aspirator 306. A Coanda device 307 disposed at the output of aspirator 306 deflects the attenuated fibers 308 at an angle of approximately 60° relative to vertical (i.e., the Coanda surface extends through an arc of approximately 60°). The fibers 308 are deposited on a short, inclined web-forming belt 350 disposed at an angle of approximately 30° with respect to vertical, such that fibers 308 approach belt 350 substantially perpendicularly. The web 370 formed by fibers 308 deposited on belt 350 travels down the incline and through compaction rolls 317 and 318 as web 370 is transferred to a main conveyor belt 352 for conveyance to the calender. An optional mild suction box 354 can be position beneath the horizontally oriented portion of the belt to prevent web 370 from being blown off of belt 352.

The short belt unit 355 supporting short belt 350 includes three rolls and a suction box, including dampers for adjusting the high velocity air zone to coincide with the laydown area. The 30° incline of belt 350, allows more room for quench air ducting from both sides of the fiber curtain below the spinneret (compare with the more limited room provide for ducts 354 and 355 by vertical belt 351). Angling the belt in this manner requires that the short belt with its suction box and rollers be equipped to move horizontally so that the laydown distance M can be kept at the optimal value when spinning distance L is adjusted by moving the aspirator up and down. Naturally, in this inclined arrangement, adjustment of the height of the aspirator will alter the both the spinning distance L and laydown distance M. Nevertheless, the distances L and M can still be "independently" adjusted, since virtually any desired combination of spinning distance L and laydown distance M can be achieved by appropriately moving the aspirator vertically and the short belt horizontally. Further, the moveable short belt unit 355 allows a greater variation in the laydown distance M than is practical with the arrangements shown in FIGS. 2 and 3, especially when the aspirator is at its highest position and spinning distance L is very short.

Referring again to FIG. 4, a second short belt unit 367 is used to form a second web that is subsequently transferred to the main conveyor belt 352. Specifically, a second array of fibers 355 is extruded from a spinneret 351 of a spin pack 352 of a second spin beam 353 and drawn into an aspirator 356. A Coanda device 357 disposed at the output of aspirator 356 horizontally deflects the attenuated fibers 358 discharged from aspirator 356 toward a vertical portion of a second short belt 351. Like belt 350, belt 351 is moveable horizontally to adjust the laydown distance M. Short belt unit 367 includes four rolls and a suction box, including dampers for adjusting the high velocity air zone to coincide with the laydown area.

The web 363 formed by fibers 358 deposited on belt 351 travels vertically downward and through compaction rolls 380 and 381 as web 363 is transferred to main conveyor belt 352 and is laid on top of web 370 for conveyance to the calender. An optional mild suction box 382 can be position beneath the horizontally oriented portion of the belt conveying the two webs to prevent them from being blown off of belt 352. Each of mild suction boxes 354 and 382 moves horizontally along with respective short belt units 355 and 367 so that the mild suction assures transfer of the web from the respective short belt to the main belt 352.

Depositing at least one web on a short belt unit separate from the main conveyor belt offers another potential advantage. Depending on the type of web being made and the quantity and velocity of air exiting the second aspirator, the first web may be disturbed by the air exiting the second aspirator in arrangements such as those shown in FIGS. 2 and 3 where the second laydown is made directly onto the first web. In the arrangement shown in FIG. 4, the second web 363 is laid down by the aspirator onto a bare screen belt and then transferred to the main conveyor on top of the first web 370, eliminating any possible disturbance problem.

While shown with two short belts and two webs in FIG. 4, it will be understood that the embodiment shown in FIG. 4 can be extended to include any practical number (i.e., three or more) of web deposition areas with a corresponding number of spin beams and aspirators.

As shown in FIG. 4, conventional, vertically stacked calender rolls 490 and 491 can be can be used to bond the layered webs. Alternatively, a novel horizontally-arranged three calendar roll assembly can be used to bond the layered web. Assembly 492 includes a left patterned calender roll 493, a right patterned calender roll 494 and a smooth center calender roll 495. The center roll 495 can be urged against either the left roll 493 or right roll 494 to form a nip through which the web is fed. Advantageously, if one of the patterned rolls becomes damaged, that roll can be taken off line and the other patterned roll can be used with the center roll. Alternatively, two patterned rolls with different patterns can be switched on and off line as desired. Because the horizontal rolls simply pick the web up vertically from the belt, the horizontal three rolls arrangement is more advantageous than the above-described stacked three calender roll arrangement (FIG. 3) in that no adjustments to the belt position need to be made when switching from one set of rolls to the other.

While the use of a Coanda device is particularly useful in the present invention for deflecting the fiber arrays, if separating drips from the fibers is not important, such as in a good spinning process where drips rarely form, the Coanda device can be replaced by a simple 90° deflection device 56 (shown in FIG. 1). Such a device would, however, deflect any drips onto the belt along with the fibers. Another disadvantage to such a deflection device is that the fibers would be driven by the compressed air exiting the aspirator to impact quite forcefully against the deflection device, tending to rub some polymer off of the fibers onto the deflector surface. This will require that the deflector be cleaned relatively often (e.g., on the order of hours) to avoid high friction of the fibers on the deflector. In contrast, the embodiment employing the Coanda device may run for days or weeks before requiring cleaning of the device. Such a deflector might be advantageous if the aspirator conditions prevented a Coanda device from effectively deflecting all of the fibers exiting the aspirator by 90° degrees so that all of the fibers are deposited in the desired place on the screen wire belt.

In accordance with another embodiment of the present invention, the Coanda device can be replaced by an aspirator having a discharge slot that turns or bends 90° at the exit end. Such aspirator would deflect all fibers onto the vertical belt.

While most synthetic fiber spinning is done vertically downward, many machines have been built specifically to spin polypropylene polymer vertically upward. The process of this invention would work just as well in this case. Specifically, the spinneret is in a fixed location near the floor, the aspirator is positioned above the spinneret, and an adjacent belt travels substantially vertically. Such an apparatus can be started up opening the slot of the slot aspirator and using a portable string-up aspirator to bring the fibers through the slot aspirator. Such a machine lacks the desirable feature of having gravity automatically restring any broken filament, as is the case if spinning is done vertically downward.

Another option is to spin fibers horizontally from a fixed spinneret that has its face disposed in a vertical plane. In this case, the fibers proceed horizontally through the aspirator and are deflected downward by a Coanda device onto a horizontal belt. Note that such an arrangement would allow the spinning distance L and laydown distance M to be independently adjusted by moving the aspirator and/or moving the trailing edge of the Coanda device. More generally, the present invention encompasses any orientation of the spin beam, aspirator and web-forming belt wherein the fibers are deflected at the output of the aspirator, such that the spinning distance L and laydown distance M lie along non-parallel lines (e.g., along lines that lie at an angle of at least 45° with respect to each other) so that distances L and M can be independently adjusted without moving the spin beam and without vertically moving the web-forming belt. In essence, the fact that the spinning distance L and laydown distance M lie along lines that are at angle with respect to each other (instead of being substantially parallel) is what permits these distances to be varied independently with greater ease, and the fiber deflection techniques of the present invention are what allow the spinning distance L and laydown distance M to lie along relatively angled lines.

While described primarily in the context of slot-type aspirators, it will be understood that gun-type aspirators can also be used in the context of the present invention. For example, fibers can be extruded in patch-like arrays from a groups of orifices, with each array being fed to a corresponding gun-type aspirator. Each gun-type aspirator can have a corresponding Coanda device that deflects the fibers exiting the aspirator. Alternatively, the outputs of several gun-type aspirators can lie at different points along one long Coanda device (e.g., every two inches) that deflects all of the fiber bundles.

The web formation technique of the present invention can be used with virtually any type of melt spun polymeric fibers, including but not limited to, single-component monofilaments and plural component fibers such as island-in-the-sea fibers, sheath-core fibers and splittable fibers and combinations thereof. For example, both splittable and non-splittable fibers can be extruded from a single spinneret or plural spinnerets to create a web having a mixture of different types of fiber or fiber shapes. According to a particularly advantageous embodiment, a web formed with at least some fibers having a high-melting core and a thin, low-melting sheath would facilitate web bonding by directing hot air through the web after leaving the wire belt in order to melt the sheath, thereby eliminating the need for costly calender rolls.

Further, a web formed from separated sub-fibers can be coupled to (e.g., bonded to) other types of webs or laminates in, for example, a multi-layered product. In the case of splittable plural-component fibers, the spunbond web formation techniques of the present invention can be used in conjunction with the in-line fiber splitting spunbond system disclosed in International Patent Application No. PCT/US98/21378, the disclosure of which is incorporated herein by reference in its entirety. The term "in-line", as used herein refers to a process wherein fiber extrusion, splitting and web formation are performed in a single, continuous process (i.e., not in-line would be if the extruded fibers are made into a roll and then split or formed into a web separately).

Furthermore, the extruded fibers can have virtually any transverse cross-sectional shape, including, but not limited to: round, elliptical, ribbon shaped, dog bone shaped, and multilobal cross-sectional shapes. The fibers comprise any one or combination of melt spinnable resins, including, but not limited to: homopolymer, copolymers, terpolymers and blends thereof of: polyolefins, polyamides, polyesters, polyactic acid, nylon, poly(trimethylene terephthalate), and elastomeric polymers such as thermoplastic grade polyurethane. Suitable polyolefins include without limitation polymers such as polyethylene (e.g., polyethylene terephthalate, low density polyethylene, high density polyethylene, linear low density polyethylene), polypropylene (isotactic polypropylene, syndiotactic polypropylene, and blends of isotactic polypropylene and atactic polypropylene), poly-1-butene, poly-1-pentene, poly-1-hexene, poly-1-octene, polybutadiene, poly-1,7,-octadiene, and poly-1,4,-hexadiene, and the like, as well as copolymers, terpolymers and mixtures of thereof.

The process of forming fabric from the plural-component fibers of the present invention is not limited to the particular apparatus and processes described in connection with FIGS. 1–4, and additional or modified processing techniques are considered to be within the scope of the invention. For example, one or more godets may be used prior to the aspirator for drawing and/or relaxing the fibers. A downstream godet may be operated at higher speed than an upstream godet to stretch the fibers, or a downstream godet may be operated at a lower speed than an upstream godet to relax the fibers.

In web formation techniques of the present invention can be used in combination with other technologies to form composite materials. For example, other sheet technologies, such as melt blown or film composites (including laminates) can be combined with the fiber extrusion processes of the present invention. The present invention also encompasses mixed fiber embodiments, wherein separated sub-fibers and conventional (e.g., non-split) fibers are simultaneously spun from a single spinneret to produce a web of mixed fiber composition. The fibers may be composed of a variety of different resins.

Finally, it should be noted that adjustments to the spinning distance L and laydown distance M can be made in accordance with the present invention either prior to running of the apparatus to form web or during web formation in order to optimize the distance L and M for a desired fiber denier, for maximum fabric production and/or for minimum fiber breakage.

Having described preferred embodiments of new and improved methods and apparatus for spunbond web formation, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A method of forming a non-woven web from extruded polymer fibers, the method comprising the steps of:

(a) extruding a plurality of polymer fibers from an output of a spinneret;

(b) directing the extruded fibers from the spinneret output to an input of an aspirator, wherein the aspirator input is positioned at a selected spinning distance from the spinneret output;

(c) drawing the fibers through an aspirator to thereby attenuate the fibers;

(d) deflecting the attenuated fibers in a direction that is non-parallel relative to a direction at which the fibers enter the aspirator input;

(e) depositing the deflected fibers onto a forming surface to form a non-woven fibrous web; and (f) adjusting the spinning distance by relatively moving the spinneret and the aspirator toward or away from each other.

2. The method of claim 1, wherein step (d) further comprises deflecting the attenuated fibers in a direction that is at an angle of at least 45° relative to the direction at which the fibers enter the aspirator input.

3. The method of claim 1, wherein step (d) further comprises deflecting the attenuated fibers in a direction that is substantially perpendicular to the direction at which the fibers enter the aspirator input.

4. The method of claim 1, wherein step (d) further comprises directing the fibers past a deflection surface having a trailing edge located at a selected laydown distance from the forming surface.

5. The method of claim 4, further comprising:

(g) adjusting the laydown distance by relatively moving the forming surface and the trailing edge of the deflection surface toward or away from each other.

6. The method of claim 5, wherein step (f) includes moving the aspirator toward or away from a stationary spinneret.

7. The method of claim 5, wherein step (f) does not alter the laydown distance.

8. The method of claim 5, wherein step (g) does not alter the spinning distance.

9. The method of claim 5, wherein step (g) includes at least one of:

(g1) relatively moving the forming surface and the aspirator toward or away from each other;

(g2) moving the trailing edge of the deflection surface toward or away from the forming surface; and (g3) moving the forming surface toward or away from the trailing edge of the deflection surface.

10. The method of claim 9, wherein step (g1) includes moving the aspirator horizontally.

11. The method of claim 9, wherein step (g2) includes moving the trailing edge of the deflection surface toward or away from the forming surface by changing the shape of the deflection surface.

12. The method of claim 9, wherein step (g2) includes moving the trailing edge of the deflection surface toward or away from the forming surface by replacing the deflection surface with another deflection surface having a different size.

13. The method of claim 9, wherein step (g3) includes moving a non-horizontally-oriented forming surface in a horizontal direction.

14. The method of claim 4, further comprising:

(g) independently adjusting the spinning distance and the laydown distance while moving only one of the spinneret, the aspirator and the forming surface in a vertical direction.

15. The method of claim 4, further comprising:

(g) moving at least one of the aspirator and the spinneret relative to the other in a direction that is substantially parallel to a plane in which a portion of the forming surface that receives deflected fibers resides such that the spinning distance is varied while maintaining the selected laydown distance.

16. The method of claim 4, further comprising:

(g) varying the laydown distance while maintaining the selected spinning distance, wherein the varying step comprises at least one of:

(g1) moving the aspirator in a direction substantially perpendicular to the direction at which fibers enter the aspirator input;

(g2) moving the trailing edge of the deflection surface in a direction parallel to the direction in which fibers are deflected;

(g3) changing a curvature of the deflection surface; and (g4) moving the forming surface toward the trailing edge of the deflection surface.

17. The method of claim 4, wherein step (d) further comprises deflecting the fibers along a curved surface toward the forming surface for deposition thereon.

18. The method of claim 17, wherein step (c) includes drawing ambient air into the aspirator input and ejecting air from an output of the aspirator, and step (d) includes employing the Coanda effect to deflect air and fibers entrained in the air along a convex surface as the air and fibers emerge from the aspirator output.

19. The method of claim 4, wherein step (d) includes deflecting the fibers within the aspirator along the deflection surface such that a desired deflection is achieved upon the exit of fibers from an output of the aspirator.

20. The method of claim 1, wherein the extruded fibers are directed in a generally vertical direction from the spinneret output to the aspirator input in step (b) and the attenuated fibers are deflected in a generally horizontal direction in step (d).

21. The method of claim 1, further comprising:

(g) bonding the fibers of the fibrous web together after the deposition step by feeding the fibrous web between two calender rolls whose axes lie in substantially the same horizontal plane.

22. The method of claim 1, further comprising:

(g) extruding a plurality of second polymer fibers from an output of a second spinneret;

(h) drawing the plurality of second polymer fibers from an input of a second aspirator and through the second aspirator thereby attenuating the fibers; and (i) subsequent to step (e), depositing the attenuated fibers emerging from the second aspirator output onto the forming surface to form a non-woven fibrous web from both said plurality of polymer fibers and said plurality of second polymer fibers.

23. The method of claim 22, wherein step (i) includes depositing the plurality of second polymer fibers over the non-woven fibrous web already formed on the forming surface in step (e) thereby forming a two-layered non-woven fibrous web.

24. A method of processing extruded polymer fibers, the method comprising the steps of:

(a) drawing the fibers through an aspirator to thereby attenuate the fibers; and (b) deflecting the attenuated fibers from an output of the aspirator along a curved surface and in a direction that is non-parallel relative to a direction at which the fibers enter the aspirator.

25. An apparatus for manufacturing a non-woven polymeric fibrous web, the apparatus comprising:

a spinneret that extrudes polymer fibers;

an aspirator having an input and an output, wherein the aspirator input is located a selected spinning distance from the spinneret, the aspirator receives extruded polymer fibers at the aspirator input, attenuates the fibers and ejects the attenuated fibers from the aspirator output, and at least one of the aspirator and the spinneret is movable toward or away from the other of the aspirator and the spinneret to change the spinning distance;

a deflection surface located in proximity to the aspirator output so as to deflect attenuated fibers from the aspirator in a direction that is non-parallel to the direction in which the fibers enter the aspirator input; and a forming surface aligned with the deflection surface such that fibers deflected by the deflection surface form a non-woven fibrous web upon deposition on the forming surface.

26. The apparatus of claim 25, wherein the deflection surface deflects attenuated fibers from the aspirator in a direction that is at an angle of at least 45° relative to the direction at which fibers enter the aspirator input.

27. The apparatus of claim 25, wherein the deflection surface deflects attenuated fibers from the aspirator in a direction that is substantially perpendicular to the direction at which fibers enter the aspirator input.

28. The apparatus of claim 25, wherein the deflection surface has a trailing edge that is located at a selected laydown distance from the forming surface.

29. The apparatus of claim 28, wherein movement of the aspirator toward or away from the spinneret changes the spinning distance without changing the laydown distance.

30. The apparatus of claim 28, wherein the aspirator is moveable in a direction substantially parallel to a plane in which a portion of the forming surface that receives deflected fibers resides so as to vary the spinning distance while maintaining the selected laydown distance.

31. The apparatus of claim 28, wherein the trailing edge of the deflection surface is moveable in a direction toward or away from the forming surface such that movement of the trailing edge changes the laydown distance.

32. The apparatus of claim 31, wherein movement of the trailing edge toward or away from the forming surface changes the laydown distance without changing the spinning distance.

33. The apparatus of claim 28, wherein the trailing edge of the deflection surface is moveable in a direction substantially perpendicular to the direction at which fibers enter the aspirator input so as to vary the laydown distance while maintaining the selected spinning distance.

34. The apparatus of claim 28, wherein the forming surface is moveable in a direction toward or away from the trailing edge of the deflection surface such that movement of the forming surface changes the laydown distance without changing the spinning distance.

35. The apparatus of claim 28, wherein the deflection surface is located between the aspirator input and the aspirator output such that the trailing edge of the deflection surface is located adjacent the aspirator output and deflected fibers emerge from the aspirator output.

36. The apparatus of claim 28, wherein the deflection surface is a device having a leading edge adjacent the aspirator output and a curved surface disposed between the leading and trailing edges such that fibers are deflected along the curved surface toward the forming surface for deposition thereon.

37. The apparatus of claim 36, wherein the deflection surface is a Coanda device and the curved surface is convex such that fibers entrained in air emerging from the aspirator output are deflected along the convex surface.

38. The apparatus of claim 37, wherein the curvature of the device is alterable so as to vary the laydown distance between the trailing edge of the Coanda device and the forming surface.

39. The apparatus of claim 25, wherein the aspirator is aligned with the spinneret such that fibers enter the aspirator input in a substantially vertical direction and fibers are deflected from the aspirator output in a substantially horizontal direction.

40. The apparatus of claim 25, wherein the aspirator is one of a slot-shaped aspirator and a gun-type aspirator.

41. The apparatus of claim 25, further comprising:

a second spinneret that extrudes second polymer fibers; and a second aspirator that receives and attenuates the extruded second polymer fibers and ejects attenuated fibers from a second aspirator output onto the forming surface;

wherein the forming surface is aligned with the aspirators such that a first non-woven fibrous web layer is formed on the forming surface by polymer fibers deflected by the deflection surface and a second non-woven fibrous web layer is formed on the forming surface by the second polymer fibers ejected from the second aspirator output.

42. The apparatus of claim 41, wherein the forming surface is aligned with the aspirators such that one of the first and second layers is formed over the other of the first and second layers thereby forming a two-layered fibrous web on the forming surface.

43. The apparatus of claim 25, further comprising a plurality of calendar rolls urged closely together in horizontal alignment with respect to each other such that bonding of the non-woven fibrous web occurs as the web passes between two of the calendar rolls.

44. A two-stage web laydown method of forming a non-woven web from extruded polymeric fibers comprising:

(a) extruding a first set of polymer fibers from a first spinneret;

(b) drawing the first set of extruded fibers through a first aspirator thereby attenuating the first set of fibers;

(c) depositing the first set of attenuated fibers emerging from the first aspirator output onto a forming surface to form a first non-woven fibrous web layer;

(d) extruding a second set of polymer fibers from a second spinneret;

(e) drawing the second set of extruded polymer fibers through a second aspirator thereby attenuating the second set of fibers; and (f) depositing the second set of attenuated fibers emerging from the second aspirator onto the first web layer to form a two-layered non-woven fibrous web.

45. The method of claims 44, further comprising:

(g) deflecting at least one of the first and second sets of polymer fibers from an output of at least one respective aspirator in a direction that is non-parallel to the direction at which the at least one of the first and second sets of polymer fibers enters the at least one respective aspirator.

46. A two-stage web laydown apparatus for manufacturing a non-woven polymeric fibrous web, the apparatus comprising:

a first spinneret that extrudes a first set of polymer fibers;

a first aspirator that receives and attenuates the first set of extruded polymer fibers emerging from the first spinneret;

a second spinneret that extrudes a second set of polymer fibers;

a second aspirator that receives and attenuates the second set of extruded polymer fibers emerging from the second spinneret; and a forming surface aligned with the first and second aspirators;

wherein the first and second aspirators are aligned with the forming surface such that a first non-woven fibrous web layer is formed on the forming surface by the first set of polymer fibers exiting the first aspirator and a second non-woven fibrous web layer is formed over the first non-woven fibrous web layer by the second set of polymer fibers exiting the second aspirator to form a two-layered non-woven fibrous web on the forming surface.

47. The apparatus of claim 46, further comprising a deflection device aligned with at least one of the first and second aspirator outputs, wherein the deflection device receives and deflects attenuated fibers from the at least one of the first and second aspirator outputs in a direction that is non-parallel to the direction in which the fibers enter the respective at least one of the first and second aspirators.

48. An apparatus for manufacturing a non-woven polymeric fibrous web, the apparatus comprising:

a spinneret that extrudes polymer fibers;

an aspirator that receives and attenuates extruded polymer fibers emerging from the spinneret;

a forming surface that receives attenuated polymer fibers emerging from the aspirator such that a non-woven fibrous web forms on the forming surface; and a plurality of calendar rolls urged closely together and spaced in horizontal alignment such that bonding of the non-woven fibrous web occurs as the web passes from the forming surface between two of the calendar rolls;

wherein the plurality of calendar rolls comprises at least one smooth calendar roll disposed horizontally between two patterned calendar rolls.

49. The method of claim 14, further comprising:

(h) moving at least one of the spinneret, the aspirator, the forming surface and the deflection surface horizontally.

50. The method of claim 4, further comprising the steps of:

(g) adjusting the spinning distance by moving the aspirator vertically; and (h) adjusting the laydown distance by moving the aspirator horizontally.

51. A method of forming a non-woven web from extruded polymer fibers, the method comprising the steps of:

(a) extruding a plurality of polymer fibers from an output of a spinneret;

(b) directing the extruded fibers from the spinneret output to an input of an aspirator, wherein the aspirator input is positioned at a selected spinning distance from the spinneret output;

(c) drawing the fibers through an aspirator to thereby attenuate the fibers;

(d) deflecting the attenuated fibers in a direction that is greater than 45° relative to a direction at which the fibers enter the aspirator input; and (e) depositing the deflected fibers onto a forming surface to form a non-woven fibrous web.

52. The method of claim 51, wherein step (d) further comprises deflecting the attenuated fibers in a direction that is substantially perpendicular to the direction at which the fibers enter the aspirator input.

53. A method of forming a non-woven web from extruded polymer fibers, the method comprising the steps of:

(a) extruding a plurality of polymer fibers from an output of a spinneret;

(b) directing the extruded fibers from the spinneret output to an input of an aspirator, wherein the aspirator input is positioned at a selected spinning distance from the spinneret output;

(c) drawing the fibers through an aspirator to thereby attenuate the fibers;

(d) deflecting the attenuated fibers along a curved surface toward a forming surface; and (e) depositing the deflected fibers onto the forming surface to form a non-woven fibrous web.

54. An apparatus for manufacturing a non-woven polymeric fibrous web, the apparatus comprising:

a spinneret that extrudes polymer fibers;

an aspirator having an input and an output, wherein the aspirator input is located a selected spinning distance from the spinneret and the aspirator receives extruded polymer fibers at the aspirator input, attenuates the fibers and ejects the attenuated fibers from the aspirator output;

a deflection surface located in proximity to the aspirator output so as to deflect attenuated fibers from the aspirator in a direction that is greater than 45° relative to the direction in which the fibers enter the aspirator input; and a forming surface aligned with the deflection surface such that fibers deflected by the deflection surface form a non-woven fibrous web upon deposition on the forming surface.

55. The apparatus of claim 54, wherein the deflection surface deflects attenuated fibers from the aspirator in a direction that is substantially perpendicular to the direction at which fibers enter the aspirator input.

56. An apparatus for manufacturing a non-woven polymeric fibrous web, the apparatus comprising:

a spinneret that extrudes polymer fibers;

an aspirator having an input and an output, wherein the aspirator input is located a selected spinning distance from the spinneret and the aspirator receives extruded polymer fibers at the aspirator input, attenuates the fibers and ejects the attenuated fibers from the aspirator output;

a deflection surface located in proximity to the aspirator output having a curved surface that deflects attenuated fibers from the aspirator in a direction that is non-parallel relative to the direction in which the fibers enter the aspirator input; and a forming surface aligned with the deflection surface such that fibers deflected by the deflection surface form a non-woven fibrous web upon deposition on the forming surface.

57. The method of claim 45, wherein (g) includes:

(g.1) deflecting at least one of the first and second sets of polymer fibers from an output of at least one respective aspirator along a curved surface.

58. The apparatus of claim 47, wherein the deflection device includes a curved surface to deflect attenuated fibers from the at least one of the first and second aspirator outputs.

59. An apparatus for manufacturing a non-woven polymeric fibrous web, the apparatus comprising:

a spinneret that extrudes polymer fibers;

an aspirator having an input and an output, the aspirator input being located a selected spinning distance from the spinneret to receive extruded polymer fibers from the spinneret, attenuate the extruded fibers and eject the attenuated fibers from the aspirator output; and a forming surface located a selected laydown distance from the aspirator output to receive attenuated fibers from the aspirator output and form a non-woven fibrous web on the forming surface;

wherein at least one of the aspirator and the spinneret is movable toward or away from the other of the aspirator and the spinneret to change the spinning distance, at least one of the aspirator and the forming surface is movable toward or away from the other of the aspirator and the forming surface to change the laydown distance, and the spinneret, the aspirator and the forming surface are all aligned with respect to each other such that a selected movement of the aspirator changes one of the spinning distance and the laydown distance while maintaining the other of the spinning distance and the laydown distance.

60. An apparatus for manufacturing a non-woven polymeric fibrous web, the apparatus comprising:

a spinneret that extrudes polymer fibers;

an aspirator having an input and an output, the aspirator input being located a selected spinning distance from the spinneret to receive extruded polymer fibers from the spinneret, attenuate the extruded fibers and eject the attenuated fibers from the aspirator output; and a forming surface located a selected laydown distance from the aspirator output to receive attenuated fibers from the aspirator output and form a non-woven fibrous web on the forming surface;

wherein at least one of the spinneret and the aspirator is movable vertically with respect to the other of the spinneret and the aspirator to change the spinning distance independently of the laydown distance.

61. The apparatus of claim 60, wherein at least one of the aspirator and the forming surface is movable horizontally with respect to the other of the aspirator and the forming surface to change the laydown distance independently of the spinning distance.

* * * * *